US011442382B2

(12) United States Patent
Suzuki et al.

(10) Patent No.: US 11,442,382 B2
(45) Date of Patent: Sep. 13, 2022

(54) IMAGING SYSTEM WITH GLOSS TREATMENT DEVICE

(71) Applicant: Hewlett-Packard Development Company, L.P., Spring, TX (US)

(72) Inventors: Yasuo Suzuki, Yokohama (JP); Koichi Utsunomiya, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/299,072

(22) PCT Filed: Jul. 15, 2020

(86) PCT No.: PCT/US2020/042089
§ 371 (c)(1),
(2) Date: Jun. 2, 2021

(87) PCT Pub. No.: WO2021/016014
PCT Pub. Date: Jan. 28, 2021

(65) Prior Publication Data

US 2022/0137538 A1 May 5, 2022

(30) Foreign Application Priority Data

Jul. 22, 2019 (JP) ..... JP2019-134589

(51) Int. Cl.

| | |
|---|---|
| ***G03G 15/20*** | (2006.01) |
| ***G03G 15/00*** | (2006.01) |
| ***G03G 21/20*** | (2006.01) |

(52) U.S. Cl.
CPC ..... *G03G 15/2021* (2013.01); *G03G 15/6585* (2013.01); *G03G 21/206* (2013.01); *G03G 15/2064* (2013.01); *G03G 2215/00805* (2013.01); *G03G 2215/2032* (2013.01); *G03G 2221/1645* (2013.01)

(58) Field of Classification Search
CPC ..... G03G 15/2021; G03G 15/2017; G03G 15/2053; G03G 15/2064; G03G 15/6585; G03G 21/206; G03G 2215/00805; G03G 2215/2032; G03G 2215/00426; G03G 2221/1645
USPC ..... 399/92, 329, 341
See application file for complete search history.

(56) References Cited

U.S. PATENT DOCUMENTS

| | | | | |
|---|---|---|---|---|
| 5,890,032 A * | 3/1999 | Aslam | G03G 15/2039 | 399/329 |
| 5,893,666 A * | 4/1999 | Aslam | G03G 15/2064 | 399/329 |
| 2002/0057934 A1* | 5/2002 | Ishikawa | G03G 15/2028 | 399/329 |

(Continued)

FOREIGN PATENT DOCUMENTS

| | | |
|---|---|---|
| JP | 1992342279 | 5/1991 |
| JP | 2001039564 | 7/1999 |

(Continued)

*Primary Examiner* — Robert B Beatty
(74) *Attorney, Agent, or Firm* — Trop Pruner & Hu, P.C.

(57) ABSTRACT

An imaging system includes an endless belt to convey a medium, a heating member to heat the endless belt, a pressure member to press the endless belt against the heating member, and a cooling device. The cooling device is in contact with the endless belt at a non-linear portion of the endless belt and includes an interior space.

20 Claims, 8 Drawing Sheets

(56) References Cited

U.S. PATENT DOCUMENTS

| | | | | |
|---|---|---|---|---|
| 2002/0167681 | A1 | 11/2002 | Ide et al. | |
| 2008/0253795 | A1* | 10/2008 | Ishino | G03G 15/2064 399/92 |
| 2012/0328345 | A1* | 12/2012 | Kunii | G03G 15/6585 399/341 |
| 2013/0004220 | A1* | 1/2013 | Muramatsu | G03G 15/2021 399/329 |
| 2013/0202337 | A1 | 8/2013 | Shirai et al. | |
| 2017/0123373 | A1* | 5/2017 | Ogino | G03G 21/206 |

FOREIGN PATENT DOCUMENTS

| | | |
|---|---|---|
| JP | 2008170771 | 1/2007 |
| JP | 2009251196 | 4/2008 |
| JP | 2013003518 A | 1/2013 |
| JP | 2015014746 | 1/2015 |
| JP | 2017021281 | 7/2015 |
| JP | 5822061 | 11/2015 |
| JP | 5824903 | 12/2015 |

* cited by examiner

IMAGING SYSTEM WITH GLOSS TREATMENT DEVICE

BACKGROUND

Some imaging systems carry out gloss processing. In such an imaging system, a toner fixed to a medium is heated and pressed to be remelted and is cooled while being in close contact with a smooth belt surface to smoothen a toner surface.

DETAILED DESCRIPTION

In the following description, with reference to the drawings, the same reference numbers are assigned to the same components or to similar components having the same function, and overlapping description is omitted. Hereinafter, example imaging systems will be described with reference to the drawings. An imaging system may be an imaging apparatus such as a printer or the like, a device for an imaging apparatus such as a gloss processing device used in the imaging apparatus, or a gloss processing device provided separately from the imaging apparatus.

Figure 1:
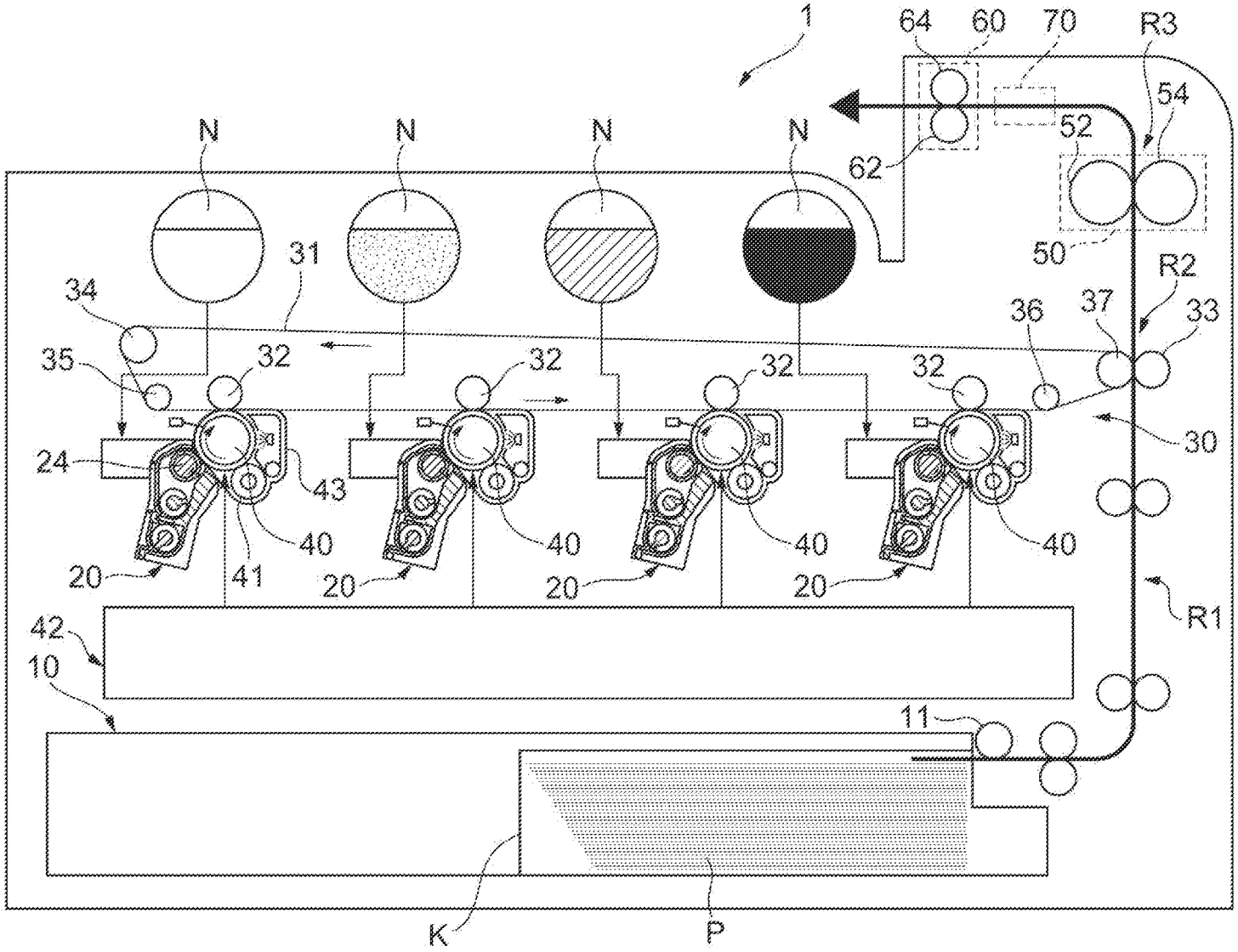
FIG. 1 is a schematic diagram of an example imaging system.

FIG. 1 is a diagram illustrating a schematic configuration of an example imaging system 1 which may form color images by using respective colors of magenta, yellow, cyan, and black. The imaging system 1 includes, for example, a conveying device 10 which conveys a sheet (e.g., a paper sheet) P corresponding to a recording medium, developing devices 20 which respectively develop an electrostatic latent image, a transfer device 30 which secondarily transfers a toner to the sheet P, image carriers 40 which respectively form an electrostatic latent image on a surface (a circumferential surface), a fixing device 50 which fixes a toner to the sheet P, and a discharge device 60 which discharges the sheet P.

The conveying device 10 conveys, for example, the sheet P which is a recording medium having an image formed thereon along a conveying route R1. The sheets P are accommodated in, for example, the cassette K in a stacked state and are picked up and conveyed by a sheet feeding roller 11. The conveying device 10 allows the sheet P to reach a transfer nip point (or transfer nip region) R2 through the conveying route R1, for example, at a timing in which the toner transferred to the sheet P reaches the transfer nip point R2.

Four developing devices 20 may be provided for the four colors, respectively. Each developing device 20 includes, for example, a developer carrier 24 which carries a toner on the image carrier 40. In the developing device 20, for example, a two-component developer including a toner and a carrier may be used as the developer. That is, in the developing device 20, the toner and the carrier may be adjusted to a target or selected mixing ratio, and the toner and the carrier may be mixed so as to uniformly disperse the toner. Accordingly, the developer may be adjusted so that an optimal charge amount is applied thereto. This developer is carried on the developer carrier 24. The developer carrier 24 rotates so as to convey the developer to a region facing the image carrier 40. Then, the toner of the developer carried on the developer carrier 24 is transferred onto the electrostatic latent image formed on the circumferential surface of the image carrier 40 so that the electrostatic latent image is developed.

The transfer device 30 conveys, for example, the toner formed by the developing devices 20 to the transfer nip point R2 in which the toner is secondarily transferred to the sheet P. The transfer device 30 includes, for example, a transfer belt 31 to which the toner is primarily transferred from the image carriers 40, tension rollers 34, 35, 36, and 37 which tension the transfer belt 31, primary transfer rollers 32 which sandwich the transfer belt 31 between the respective primary transfer rollers 32 and the respective image carriers 40, and a secondary transfer roller 33 which sandwiches the transfer belt 31 between the secondary transfer roller 33 and the tension roller 37.

The transfer belt 31 is, for example, an endless belt which rotates about the tension rollers 34, 35, 36, and 37, such that the endless belt is moved in a circulating manner by the tension rollers 34, 35, 36, and 37. Each of the tension rollers 34, 35, 36, and 37 is a roller which is rotatable about each axis. The tension roller 37 is, for example, a drive roller which rotates about the axis in a driving manner. The tension rollers 34, 35, and 36 are, for example, driven rollers rotating in a driven manner by the rotational driving of the tension roller 37. For example, the primary transfer rollers 32 are respectively provided so as to press the image carriers 40 from the inner circumference of the transfer belt 31. For example, the secondary transfer roller 33 is disposed in parallel to the tension roller 37 with the transfer belt 31 interposed therebetween and is provided so as to press against the tension roller 37 from the outer circumference of the transfer belt 31. Accordingly, the secondary transfer roller 33 forms the transfer nip point R2 between secondary transfer roller 33 and the transfer belt 31.

The image carrier 40 is also called an electrostatic latent image carrier, a photosensitive drum, or the like. Four image carriers 40 are provided for, for example, the four colors, respectively. Each image carrier 40 is provided along, for example, the movement direction of the transfer belt 31. In addition, the developing device 20, a charging roller 41, an exposure unit 42, and a cleaning device 43 may be provided around the image carrier 40.

The charging roller 41 may provide charging means which uniformly charges the surface of the image carrier 40 to a predetermined potential. The charging roller 41 rotates so as to follow, for example, the rotation of the image carrier 40. The exposure unit 42 exposes, for example, the surface of the image carrier 40 charged by the charging roller 41 in response to the image formed on the sheet P. Accordingly, a potential of a portion exposed by the exposure unit 42 in the surface of the image carrier 40 changes so that an electrostatic latent image is formed. In some examples, four developing devices 20 generate the toner by developing the electrostatic latent image formed on the image carrier 40 by using the toners supplied from the four toner tanks N respectively facing the developing devices 20. The toner tanks N are respectively filled with, for example, the toners of magenta, yellow, cyan, and black. The cleaning device 43 removes, for example, the toner remaining on the image carrier 40 after the toner formed on the image carrier 40 is primarily transferred to the transfer belt 31.

The fixing device 50 allows the sheet P to pass through, for example, a fixing nip point (or fixing nip region) R3 for heating and pressing the sheet so that the toner secondarily transferred from the transfer belt 31 to the sheet P is attached and fixed to the sheet P. The fixing device 50 includes, for example, a heating roller 52 which heats the sheet P and a pressure roller 54 which presses and rotationally drives the heating roller 52. The heating roller 52 and the pressure roller 54 are formed in, for example, a cylindrical shape and the heating roller 52 includes a heat source such as a halogen lamp provided therein. The fixing nip point R3 corresponding to a contact region is provided between the heating roller 52 and the pressure roller 54. When the sheet P passes through the fixing nip point R3, the toner is melted and fixed to the sheet P.

The discharge device 60 includes, for example, discharge rollers 62 and 64 which discharge the sheet P having the toner fixed thereto by the fixing device 50, to the outside of the apparatus.

An example of a printing process using the imaging system 1 will be described. When an image signal of a recording target image is input to the imaging system 1, a control unit of the imaging system 1 rotates the sheet feeding roller 11 so as to pick up and convey the sheets P stacked on the cassette K. Then, each surface of the image carriers 40 is uniformly charged to a predetermined potential by the charging roller 41 (a charging operation). Then, each surface of the image carriers 40 is irradiated with a laser beam by the exposure unit 42 on the basis of the received image signal so that an electrostatic latent image is formed (an exposure operation).

In each developing device 20, the electrostatic latent image is developed so that a toner is formed (a developing operation). Each toner formed in this way is primarily transferred from the image carrier 40 to the transfer belt 31 in a region in which the image carrier 40 faces the transfer belt 31 (a transfer operation). The toners formed on four image carriers 40 are sequentially layered (or superposed) on the transfer belt 31 so that a single composite toner is formed. Then, the composite toner is secondarily transferred to the sheet P conveyed from the conveying device 10 in the transfer nip point R2 in which the tension roller 37 faces the secondary transfer roller 33.

The sheet P to which the composite toner is secondarily transferred is conveyed to the fixing device 50. The fixing device 50 melts and fixes the composite toner to the sheet P by heating and pressing the sheet P between the heating roller 52 and the pressure roller 54 when the sheet P passes through the fixing nip point R3 (a fixing operation). Then, the sheet P is discharged to the outside of the imaging system 1 by the discharge rollers 62 and 64.

The example imaging system 1 further includes a gloss treatment device (or gloss processing device) 70. The gloss processing device 70 performs gloss processing by remelting the toner which has been fixed on the sheet P by the fixing device 50. The gloss processing device 70 is disposed between the fixing device 50 and the discharge device 60 along the conveying route (which defines a conveying direction) of the sheet P (see FIG. 1), but may be attached to the discharge device 60. In some examples, the gloss processing device may be provided separately from the imaging apparatus (e.g., an imaging apparatus according to the configuration of the imaging system 1 illustrated in FIG. 1, without the gloss processing device 70). The example imaging system 1 may operate in a gloss printing mode and a normal printing mode. The gloss printing mode is a mode in which the sheet P to which the toner is fixed, is supplied to the gloss processing device 70. The normal printing mode is a mode in which the sheet P to which the toner is fixed, is discharged to the outside while not being supplied to the gloss processing device 70, The gloss printing mode and the normal printing mode can be switched by receiving a user setting.

Figure 2:
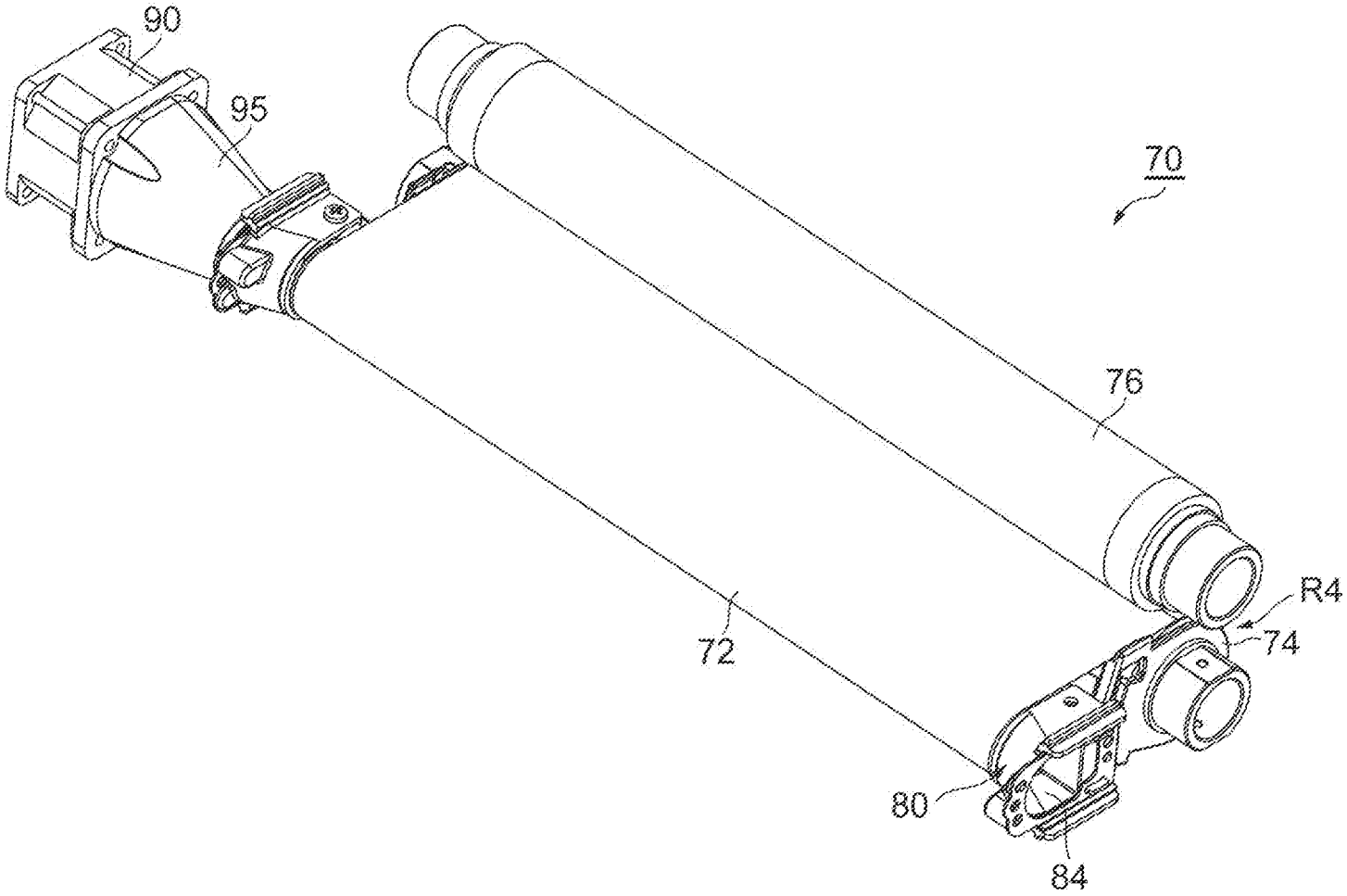
FIG. 2 is a perspective view of an example gloss processing device.
Figure 3:
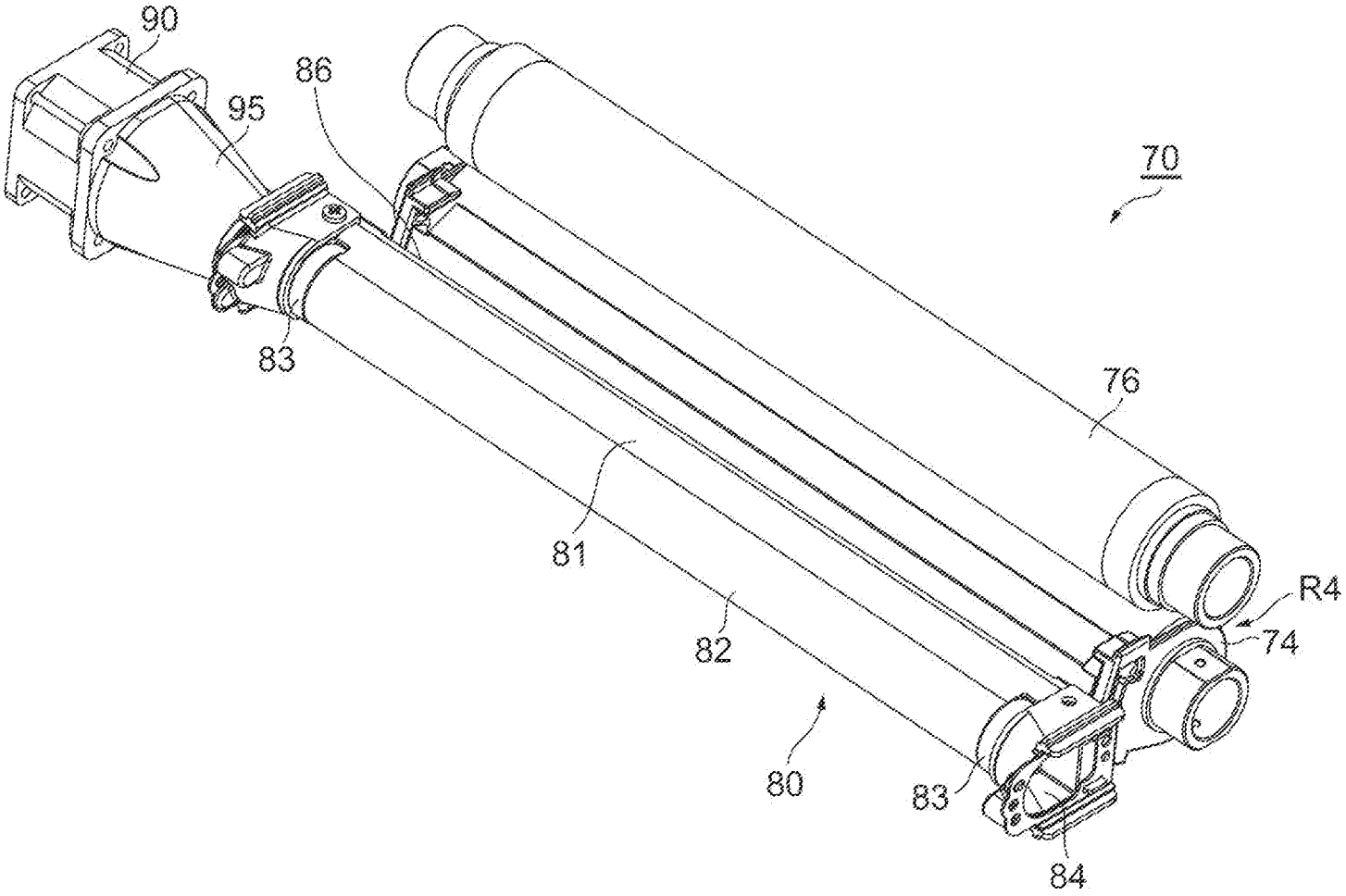
FIG. 3 is a perspective view of the gloss processing device of FIG. 2, illustrated without an endless belt.

FIGS. 2 and 3 are perspective views of the example gloss processing device 70. The example gloss processing device 70 includes, for example, a conveyor belt 72, a heating roller 74, a pressure roller 76, a circulation controlling apparatus (as a cooling apparatus or device) 80, a ventilation system 90, and an introduction member 95. In FIG. 3, the gloss processing device 70 is shown without a conveyor belt 72.

The conveyor belt 72 is an endless belt which conveys the sheet P. The conveyor belt 72 conveys the sheet by using its outer circumferential surface as a sheet conveying route. The outer circumferential surface of the conveyor belt 72 is formed as a smooth surface in order to smooth the toner of the sheet. The conveying speed of the conveyor belt 72 may be set to, for example, about 5 to 200 mm/sec.

The conveyor belt 72 is formed as a structure including two or more layers and is formed as a structure including a base material and a release layer or a structure including a base material, an elastic layer, and a release layer. In some examples, the conveyor belt 72 includes first and second base materials and a release layer. The first base material may be formed by a composition including at least one resin base material such as PI, PEEK, or PAI. The first base material may be formed to have a thickness of 30 to 150 μm in some examples, or 50 to 100 μm according to other examples. The first base material may have a thermal conductivity of 0.1 to 2 W/mk in some examples, or 0.2 to 1.6 W/mk according to other examples. The second base material may be formed of an alloy including at least one of SUS, Cu, or Ni. The second base material may be formed to have a thickness of 5 to 70 μm according to some examples, or 10 to 50 μm according to other examples. The second base material may have a thermal conductivity of 10 to 600 W/mk in some examples, or 15 to 400 W/mk according to other examples. The release layer may be formed of fluorine resin such as PFA or PTFE and may be formed so to have a thickness of 5 to 100 μm in some examples, or 10 to 50 μm according to other examples, and to have a surface roughness (Ra) of 0.3 μm or less in some examples, or 0.1 μm or less according to other examples.

Figure 4:
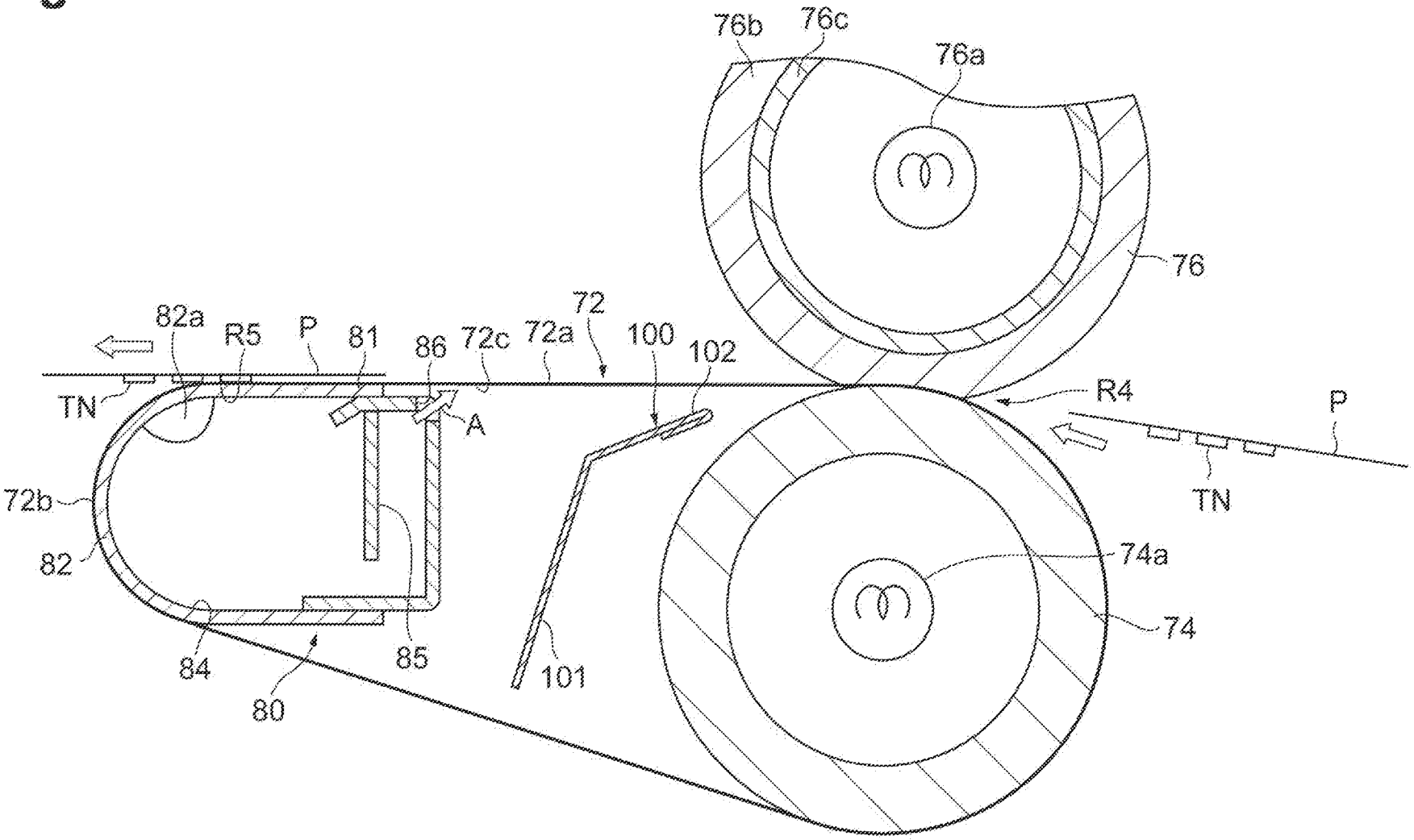
FIG. 4 is a schematic cross-sectional view of a portion of the gloss processing device of FIG. 2.

With further reference to FIG. 4, the heating roller 74 may include a heating member that heats the conveyor belt 72. For examples, the heating roller 74 may heat and remelt a toner TN fixed to the sheet P via a heating member such as a halogen lamp 74*a*. For example, the toner TN fixed to the sheet P is heated by the conveyor belt 72 which is heated by the heating roller 74. In some examples, the heating roller 74 is disposed so as to suspend (or support) the conveyor belt 72 in order to define the conveying route of the conveyor belt 72 along with the circulation controlling apparatus (or cooling device) 80. The heating roller 74 is fixed to, for example, a frame of the imaging system 1. A nip point (or nip region) R4 for heating and pressing the sheet is formed between the heating roller 74 and the pressure roller 76. At the nip point R4, the conveyor belt 72 contacts both of the heating roller 74 and the pressure roller 76. The heating roller 74 is a drive roller. Furthermore, the heating roller 74 may be a driven roller.

The heating roller 74 is formed of, for example, a metal material such as aluminum or iron, and may have an outer diameter ϕ, for example, of about 20 to 60 mm. The heating roller 74 may have a structure of two or more layers including a base material formed of a metal material and a release layer.

The pressure roller 76 is a pressure member that presses the conveyor belt 72 against the heating roller 74 and applies a pressure to the sheet P conveyed by the conveyor belt 72 when the sheet P passes through the nip point R4. The pressure roller 76 is disposed adjacent to the conveyor belt 72 in order to apply a pressure to the sheet P. That is, the pressure roller 76 is disposed opposite to the heating roller 74 with respect to the conveyor belt 72 and is pressed against the heating roller 74 with the conveyor belt 72 interposed therebetween, by a pressure mechanism. The pressure mechanism may include, for example, an urging mechanism which urges the pressure roller 76 toward the heating roller 74 and a support mechanism which supports the pressure roller 76 so as to maintain a state in which the pressure roller 76 is pressed against the heating roller 74. The pressure roller 76 may be a driven roller in some examples, or a drive roller in other examples.

The pressure roller 76 may include a layer structure of three layers including a base layer (or base material), an elastic layer, and a release layer. For example, a heating member such as a halogen lamp 76*a* may be provided in the pressure roller 76. A base layer 76*c* of the pressure roller 76 may include a metal material such as aluminum or iron. An elastic layer 76*b* of the pressure roller 76 includes, for example, silicon rubber and has a thickness of 0.1 to 20 mm and a material hardness is 5 to 60 (JIS-A). The release layer of the pressure roller 76 includes, for example, fluorine resin such as PFA or PTFE and has a thickness is 5 to 100 μm in some examples, or 10 to 50 μm in other examples. The pressure roller 76 may have an overall product hardness of, for example, 40 to 80 (Asker C). Accordingly, when the heating roller 74 and the pressure roller 76 are compared with each other, the heating roller 74 is formed of a material (for example, a metal material) having a hardness that is greater than the hardness of the pressure roller 76. Consequently, the pressure roller 76 is deformed by compression at the nip point R4. For example, the pressure roller 76 is pressed by the heating roller 74 at the nip point R4 so as to be compressed (recessed).

The circulation controlling apparatus (or cooling device) 80 may cool and solidify the toner TN that has been remelted by the heating roller 74, to smoothen the toner surface. The circulation controlling apparatus 80 may be disposed downstream of the heating roller 74 in the conveying route and serve as a tension member (or tension roller) that tensions the conveyor belt 72. That is, the conveyor belt 72 is supported (or suspended) by the heating roller 74 and the circulation controlling apparatus 80 to be tensioned (e.g., so as not to be loosened). The suspended roller or member is set to form first axis along the rotational axis of the heating roller 74 and a second axis at an axis which defines a circular arch of the circulation controlling apparatus 80. One or more additional axes of the conveyor belt 72 may be disposed downstream of the circulation controlling apparatus 80 and upstream of the heating roller 74 in the conveying route. In some examples, the circulation controlling apparatus 80 is disposed so that the conveyor belt 72 is supported from the inner circumference of the conveyor belt 72. The circulation controlling apparatus 80 includes a ventilated interior portion (or ventilation interior portion) 84 through which cooling air can flow and cools the conveyor belt 72 by the cooling air flowing through the ventilated interior portion 84. The toner TN is cooled by the conveyor belt 72 cooled by the circulation controlling apparatus 80. An example cooling method using the circulation controlling apparatus 80 will be described.

Figure 5:
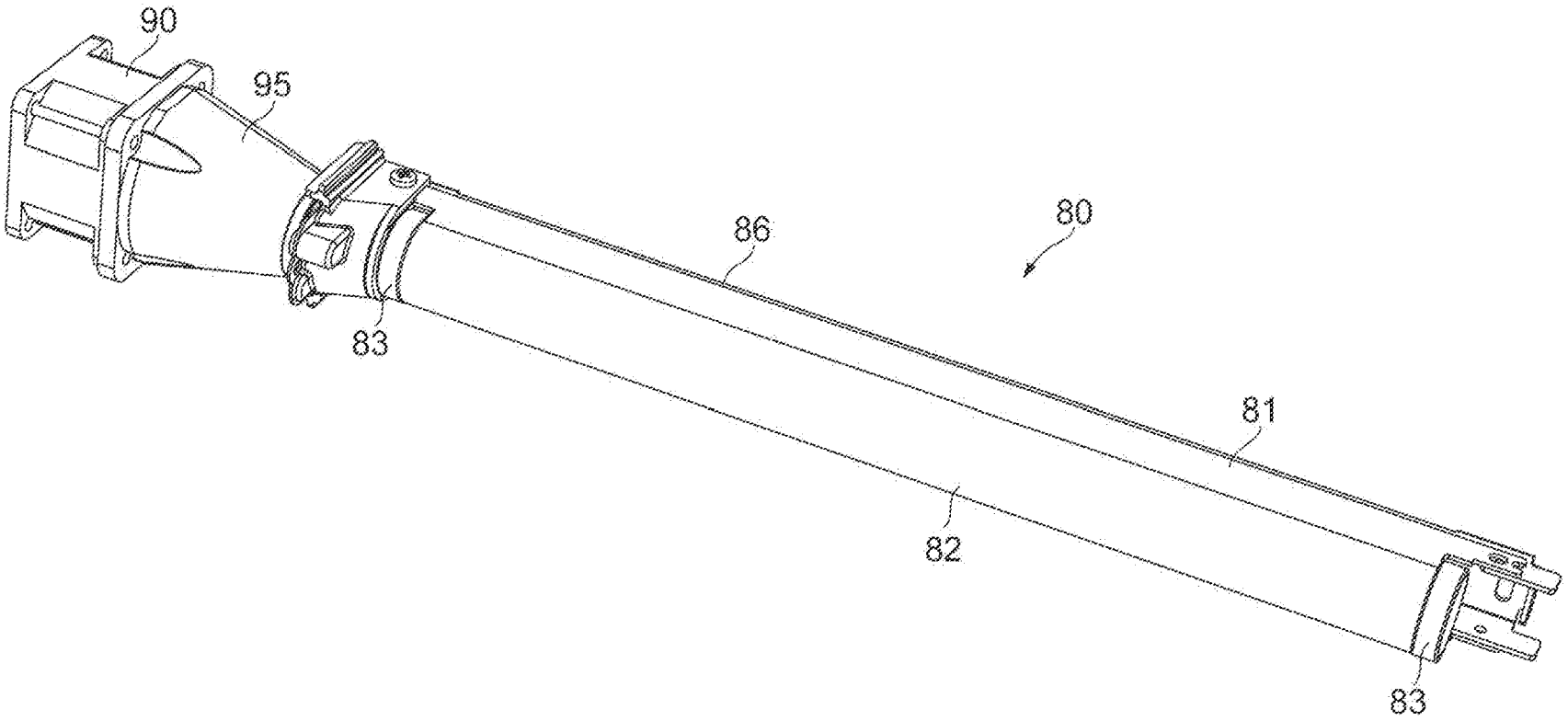
FIG. 5 is a perspective view of an example circulation controlling mechanism of the gloss processing device illustrated in FIG. 2.

With further reference to FIG. 5, the example ventilation system 90 is a device which sends cooling air into the circulation controlling apparatus (or cooling device) 80 through the introduction member 95. The ventilation system 90 includes, for example, an air fan with an axial flow means (or specification) for cooling. The ventilation system 90 may include a blower fan. The introduction member 95 defines a tapered hole having an inner diameter which decreases toward the circulation controlling apparatus 80 and is airtightly connected to the ventilation system 90 and the ventilated interior portion 84 of the circulation controlling apparatus 80. The cooling air generated from the ventilation system 90 flows into the ventilated interior portion 84 of the circulation controlling apparatus 80 through the introduction member 95 so that the airflow is widely dispersed along the entire longitudinal direction of the circulation controlling apparatus 80, and the cooling air is discharged from a slit 86 provided in the circulation controlling apparatus 80 toward an inner circumferential surface 72*c* (see FIG. 4) of the conveyor belt 72. Accordingly, the conveyor belt 72 is cooled.

Figure 6:
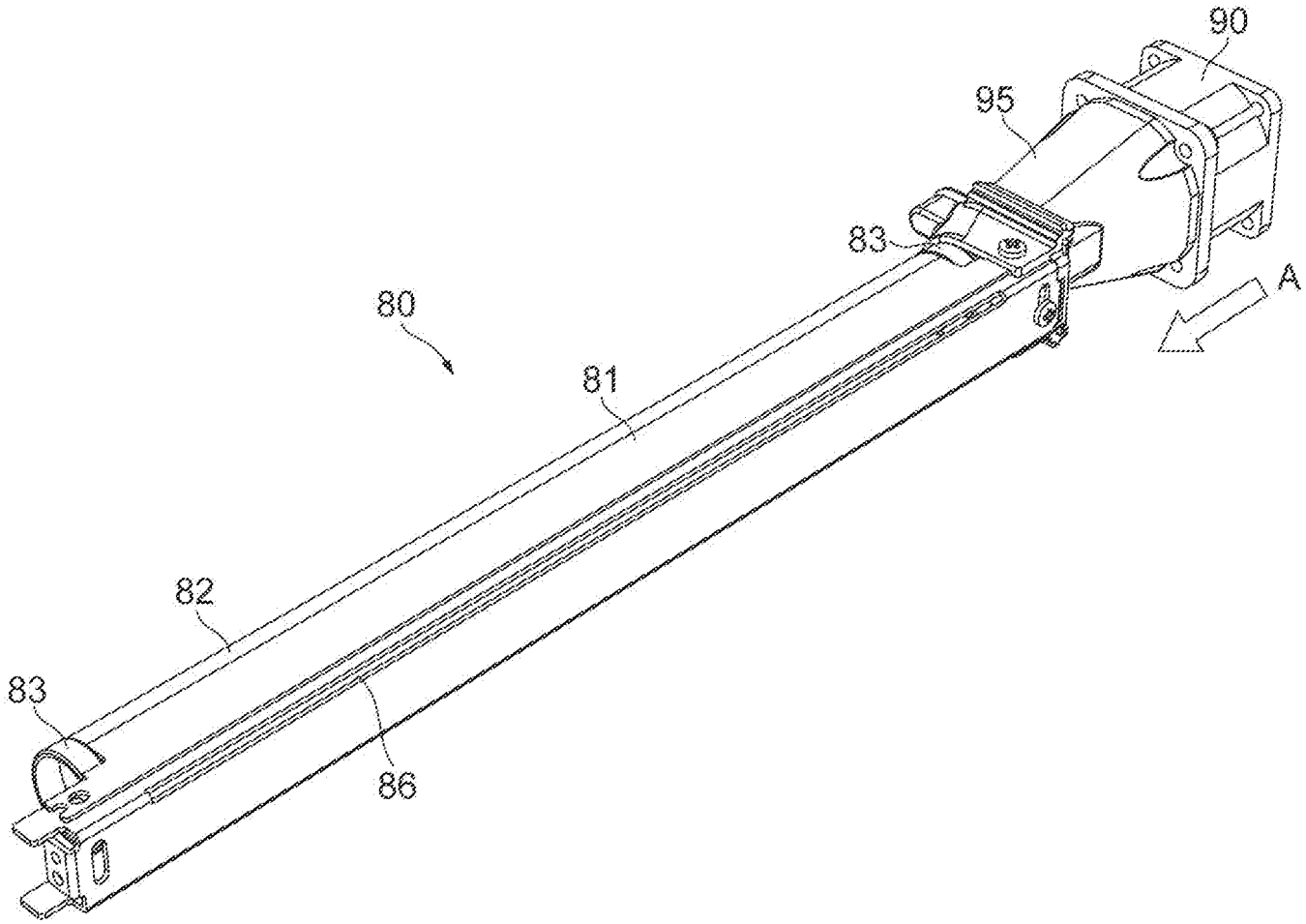
FIG. 6 is another perspective view of the circulation controlling mechanism illustrated in FIG. 5.

An example circulation controlling mechanism (or cooling mechanism) including the circulation controlling apparatus (or cooling device) 80 will be described with reference to FIGS. 4 to 6. FIG. 4 is a cross-sectional view schematically illustrating a part of an example gloss processing device. FIG. 5 is a perspective view of the circulation controlling mechanism of the example gloss processing device. FIG. 6 is a perspective view illustrating the circulation controlling mechanism illustrated in FIG. 5, viewed from a different angle. As illustrated in FIGS. 4 to 6, the circulation controlling apparatus 80 includes a flat portion 81, a curved portion 82, a pair of belt rollers 83, a ventilated interior portion (or ventilation interior portion) 84, a guide wall 85, and a slit 86.

The flat portion 81 of the cooling device 80 is a portion which contacts a linear portion 72*a* of the conveyor belt 72 extending between the nip point R4 and the separation point R5, in which the sheet P is separated from the conveyor belt 72 in a region close to the separation point R5. The outer surface of the flat portion 81 has a flat shape. The flat portion 81 constitutes a part of the outer wall of the ventilated interior portion 84 through which the cooling air flows. The cooling air flows through the ventilated interior portion 84. The flat portion 81 has a predetermined length in the conveying direction and has a length that is greater than the length (or the width) of the conveyor belt 72 in the rotation axis direction.

The curved portion 82 contacts a non-linear portion 72*b* which is a curved portion of the conveyor belt 72 returning from the separation point R5 to the heating roller 74. The outer surface of the curved portion 82 is curved. When the non-linear portion 72*b* of the conveyor belt 72 is wound around the curved portion 82, the conveyor belt is supported at the heating roller 74, to tension the conveyor belt 72. That is, the circulation controlling apparatus (or cooling device) 80 serves as a tension member or tension roller via the flat portion 81 extending from the curved portion 82 along a tangent line of the curved portion 82. The curved portion 82 has a semicircular cross-section, and since the outer surface is curved, the sheet P can be separated from the conveyor belt 72 so that the sheet P can be smoothly conveyed, to reduce the possibility of tearing of the conveyor belt 72.

A cooling member 82*a* may be provided in the vicinity of a position (e.g., R5) at which the sheet P is separated from the conveyor belt 72, inside the ventilated interior portion 84 of the curved portion 82. Accordingly, the remelted toner TN may be better separated from the conveyor belt 72 from a state in the toner TN is adhered or attached to the conveyor belt 72, by virtue of a shrinkage difference of the adhesive interface accompanied by the rapid cooling of the cooling member 82*a*. The cooling member 82*a* may include, for example, a Peltier device or a heat pipe.

The flat portion 81 and the curved portion 82 may include, for example, a metal material such as aluminum or iron. The surfaces of the flat portion 81 and the curved portion 82 may be formed of fluorine resin such as PFA or PTFE. The flat portion 81 and the curved portion 82 may include resin having a thermal conductivity of 0.5 W/mk or more in some examples, or of 1.0 W/mk or more in some examples, and/or may include carbon fiber or ceramic.

The pair of belt rollers 83 are rollers rotatably provided at opposite ends of the curved portion 82 in the longitudinal direction and assist the conveying of the conveyor belt 72. The belt roller 83 may be a metal member coated with fluorine resin or may be made of fluorine resin such as PFA.

The ventilated interior portion 84 is a space formed inside the circulation controlling apparatus (or cooling device) 80, delimited at least in part by the flat portion 81 and the curved portion 82 and extends in the longitudinal direction of the circulation controlling apparatus 80. In the ventilated interior portion 84, the cooling air generated from the ventilation system 90 which is fluidly connected to the circulation controlling apparatus 80 in an air-tight manner, through the introduction member 95, flows in the longitudinal direction. The ventilated interior portion 84 may be provided with a guide wall 85 which guides the cooling air generated from the ventilation system 90 so that the cooling air flows in the longitudinal direction. The guide wall 85 extends in the longitudinal direction of the circulation controlling apparatus 80 and prevents the cooling air introduced from the ventilation system 90 from being a windless state in the front portion (a region adjacent to the ventilation system 90) of the slit 86. Accordingly, it is possible to uniformly cool the conveyor belt 72 or the sheet P thereon in the width direction of the conveyor belt 72 (or the longitudinal direction of the circulation controlling apparatus 80). The guide wall 85 may be a plate-shaped member extending in the longitudinal direction or a member provided with air passage holes. With reference to FIGS. 5 and 6, a free end of the circulation controlling apparatus 80 which is not connected to the ventilation system 90 in the circulation controlling apparatus 80 is open. In some examples, the free end may be a closed end. In some example, another ventilation system may be provided so that the cooling air is introduced from both ends into the ventilated interior portion 84, to improve the cooling efficiency.

The slit 86 is an opening positioned at a corner portion of the circulation controlling apparatus 80, toward the heating roller 74. For example, the slit may be positioned between the flat portion 81 of the circulation controlling apparatus 80 and the heating roller 74. The slit 86 extends in the longitudinal direction. The cooling air introduced into the ventilated interior portion 84 is discharged from the slit 86 to the outside of the circulation controlling apparatus 80 and is directed toward the inner circumferential surface 72*c* of the conveyor belt 72 as indicated by an arrow A in FIG. 4, to cool the conveyor belt 72. The slit 86 is formed so that air is directed toward the inner circumferential surface 72*c* of the conveyor belt 72, and the cooling air discharged from the slit 86 cools the conveyor belt 72 and consequently the sheet P being conveyed thereon.

With reference to FIG. 4, a reflector 100 may be further provided between the heating roller 74 and the circulation controlling apparatus 80. The reflector 100 may be a plate-shaped member that serves as a wind shield wall for preventing the cooling air directed from the circulation controlling apparatus 80 toward the conveyor belt 72 from flowing toward the heating roller 74. The reflector 100 is a plate-shaped member that includes a first surface 100*a* and a second surface 100*b* opposite thereto and extends in the longitudinal direction, and can have substantially the same length as that of the slit 86 in the longitudinal direction. The reflector 100 is disposed so that the first surface 100*a* faces the circulation controlling apparatus 80 and the second surface 100*b* faces the heating roller 74. The reflector 100 includes a main portion 101 which faces the circulation controlling apparatus 80 or the heating roller 74 and an inclined portion 102 which is bent from the main portion 101 toward the heating roller 74. A gap between the inclined portion 102 and the conveyor belt 72 may be formed so as to narrow toward the heating roller 74 (e.g., toward the nip point R4) so that cooling air discharged from the slit 86 of the circulation controlling apparatus 80 is more widely directed to the conveyor belt 72.

An example gloss processing method using the example gloss processing device 70 and an example cooling method using the example circulation controlling mechanism including the circulation controlling apparatus 80, will be described. With reference to FIG. 4, when the gloss printing mode is selected and the gloss processing of the sheet P is performed, the sheet P is supplied to the nip point R4 and is heated by the heating roller 74 or the like so that the toner TN on the surface is remelted. Then, the sheet P having passed through the nip point R4 is conveyed toward the downstream by the linear portion 72*a* of the conveyor belt 72. At this time, the cooling air introduced from the ventilation system 90 is supplied to the ventilated interior portion 84 in the circulation controlling apparatus 80 and flows in the longitudinal direction along the guide wall 85. Meanwhile, the cooling air supplied to the ventilated interior portion 84 flows from the gap of the guide wall 85 toward the slit 86, along substantially the entire length of the slit 86 in the longitudinal direction, and is discharged from the slit 86 to the outside of the circulation controlling apparatus 80 so as to progressively cool the inner circumferential surface 72*c* of the conveyor belt 72. Accordingly, the conveyor belt 72 heated by the heating roller 74 and the sheet P which is conveyed thereon, are cooled rapidly. In an example, the surface temperature of the conveyor belt 72 is cooled to 55° C. or less by the rapid cooling before reaching the flat portion 81. The reflector 100 is provided in a region adjacent to the slit 86, to prevent a non-uniform heating temperature due to the cooling of the heating roller 74 by the cooling air discharged from the slit 86.

Accordingly, in the example gloss processing device 70, the circulation controlling apparatus 80 contacts the non-linear portion 72*b* of the conveyor belt 72, the non-linear portion 72*b* is partially wound around the circulation controlling apparatus 80, and the circulation controlling apparatus 80 serves as a roller and/or tension member which supports (or suspends) the conveyor belt 72. Further, the circulation controlling apparatus 80 includes a ventilated interior portion (or ventilation interior portion) for cooling the conveyor belt. The circulation controlling apparatus 80 supports (or suspends) an end of the conveyor belt 72, such that a separate tension roller is unnecessary, to decrease the size of the gloss processing device 70. Further, when the gloss processing device 70 can be decreased in size, the conveyor belt 72 can be formed as a belt having a smaller diameter or length, which may decrease the manufacturing cost. For example, the conveyor belt 72 can be formed as a belt having an inner diameter of 70 mm or less. Further, since the gloss processing device 70 can be decreased in size, for example, the gloss processing function can be mounted in smaller-sized devices such as a small home printer, to print high-quality printed materials such as photographs at home, for example.

The example gloss processing device 70 includes the ventilation system 90 which generates cooling air corresponding to an airflow passing through the ventilated interior portion 84 of the circulation controlling apparatus 80. The longitudinal direction of the circulation controlling apparatus 80 is a direction orthogonal to the conveying direction of the conveyor belt 72. The cooling air passes through the circulation controlling apparatus 80 and is directed toward the inner circumferential surface 72*c* of the conveyor belt 72, to cool the conveyor belt 72 and the sheet P conveyed by the conveyor belt 72. Further, the circulation controlling apparatus 80 includes the slit 86 extending in the longitudinal direction and the cooling air is directed toward the inner circumferential surface 72*c* of the conveyor belt 72 through the slit 86. Since the cooling air is supplied through the slit 86 which extends in the longitudinal direction, the conveyor belt 72 and the sheet P cooled by the conveyor belt 72 are uniformly cooled in the longitudinal direction of the circulation controlling apparatus 80, to subject the sheet P to a more uniform gloss process. The relatively simple shape of the slit 86 simplifies the manufacturing of the circulation controlling apparatus 80.

In the example gloss processing device 70, the circulation controlling apparatus 80 includes the guide wall 85 provided in the ventilated interior portion 84 so as to guide the cooling air in the longitudinal direction. Accordingly, it is possible to prevent a partially windless state in the longitudinal direction of the circulation controlling apparatus 80, and the amount of the cooling air supplied from the slit 86 to the outside of the circulation controlling apparatus 80, can be more uniform in the longitudinal direction.

The gloss processing device 70 further includes the reflector 100 provided between the circulation controlling apparatus 80 and the heating roller 74, to prevent the cooling air directed from the circulation controlling apparatus 80 toward the conveyor belt 72, from flowing toward the heating roller 74. Accordingly, the cooling air generated by the circulation controlling apparatus 80 is inhibited from cooling the heat generated by the heating roller 74, such that the heat of the heating roller 74 can be made more uniform. Consequently, an additional heat treatment can be reduced, which in turn reduces power consumption.

In the example gloss processing device 70, the inner circumferential surface 72*c* of the conveyor belt 72 contacts the outer circumferential surface of the circulation controlling apparatus 80, to transfer heat from the conveyor belt 72 to the circulation controlling apparatus 80 by conduction, and the heat is removed from the ventilated interior portion 84 of the circulation controlling apparatus 80 by an air flow or circulation. Accordingly, it is possible to more reliably separate the sheet P conveyed by the conveyor belt 72, from the conveyor belt 72. In an example, the conveyor belt 72 and the sheet P are rapidly cooled by the cooling air directed from the slit 86 of the circulation controlling apparatus 80 and then the conveyor belt 72 and the sheet P are further cooled to a predetermined temperature (for example, a temperature at which the toner TN does not adhere to another surface).

In the example gloss processing device 70, the circulation controlling apparatus 80 includes the pair of belt rollers 83 that rotate with the movement of the conveyor belt 72 in the conveying direction. The conveying of the conveyor belt 72 is assisted by the rotatable belt roller 83 to reduce friction with or tension applied to the conveyor belt 72, and thereby reduce the possibility of tearing the conveyor belt 72.

The example gloss processing device 70 includes the introduction member 95 that is provided between the ventilation system 90 and the circulation controlling apparatus 80 and a tapered hole having a diameter that decreases from the ventilation system 90 toward the circulation controlling apparatus 80. The tapered inner shape of the introduction member 95 strengthens the air volume of the cooling air that is introduced into the ventilated interior portion 84 of the circulation controlling apparatus 80, to increase the efficiency of cooling the conveyor belt 72 and the sheet P. In addition, since the cooling speed is increased, the conveying speed of the sheet P using the conveyor belt 72 can be increased, and the gloss processing speed can be increased.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

Figure 7:
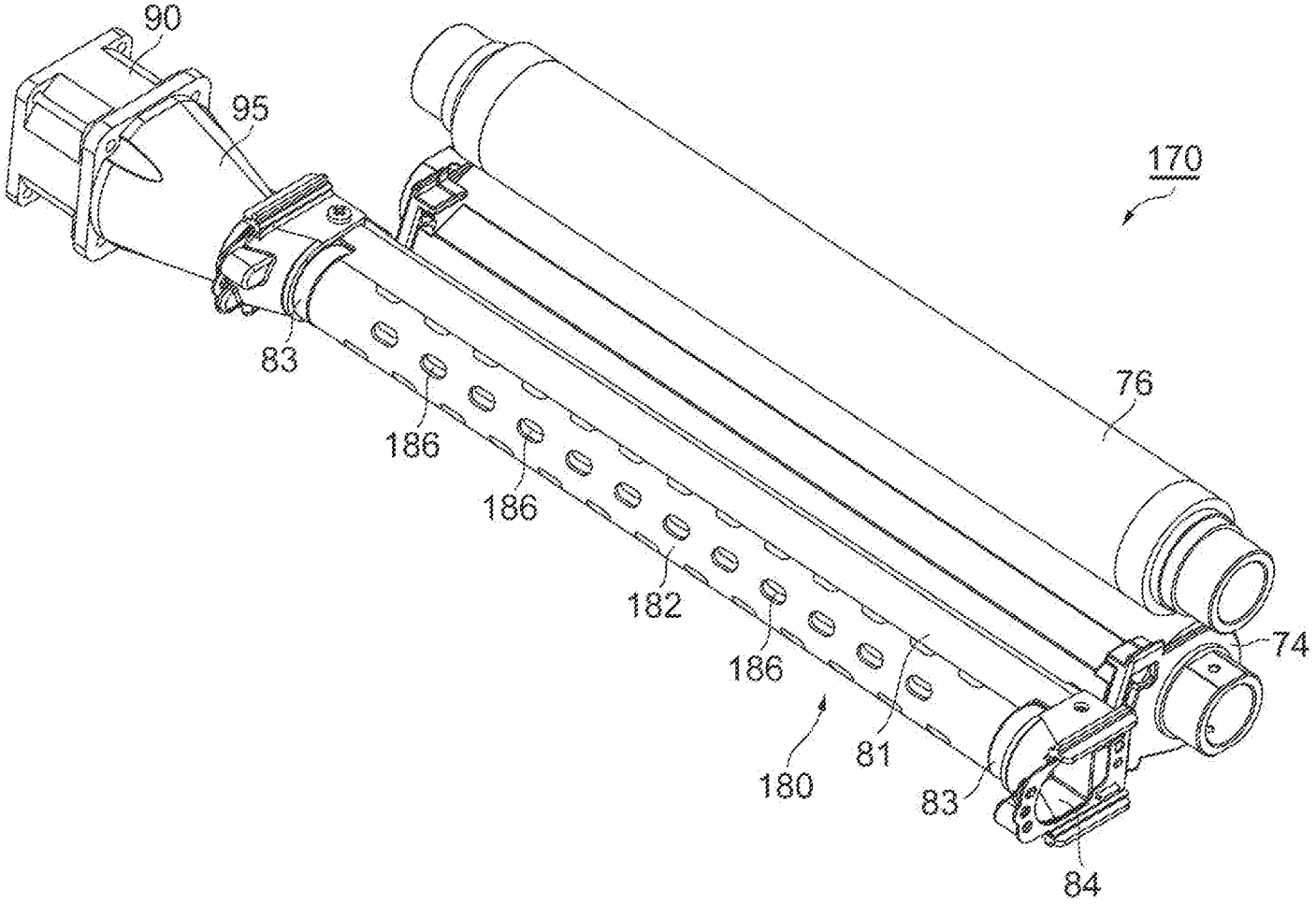
FIG. 7 is a perspective view of an example gloss processing device.

For example, with reference to FIG. 7, an example gloss processing device 170 includes a circulation controlling apparatus (or cooling device) 180 in which a curved portion 182 is provided with a plurality of holes 186 instead of the slit 86. The conveyor belt 72 is omitted in FIG. 7 for ease of understanding. The plurality of holes 186 are arranged in the longitudinal direction of the circulation controlling apparatus 180. In the gloss processing device 170, the cooling air introduced into the ventilated interior portion 84 is discharged from the plurality of holes 186 to the outside, to cool the conveyor belt 72 and the sheet P conveyed by the conveyor belt 72. The plurality of holes 186 may be arranged in the circumferential direction or along the curve of the curved portion 182, to discharge the cooling air along a wider region and thereby improve the cooling of the conveyor belt 72. In some examples, a slit similar to the slit 86 may be further provided.

Figure 8:
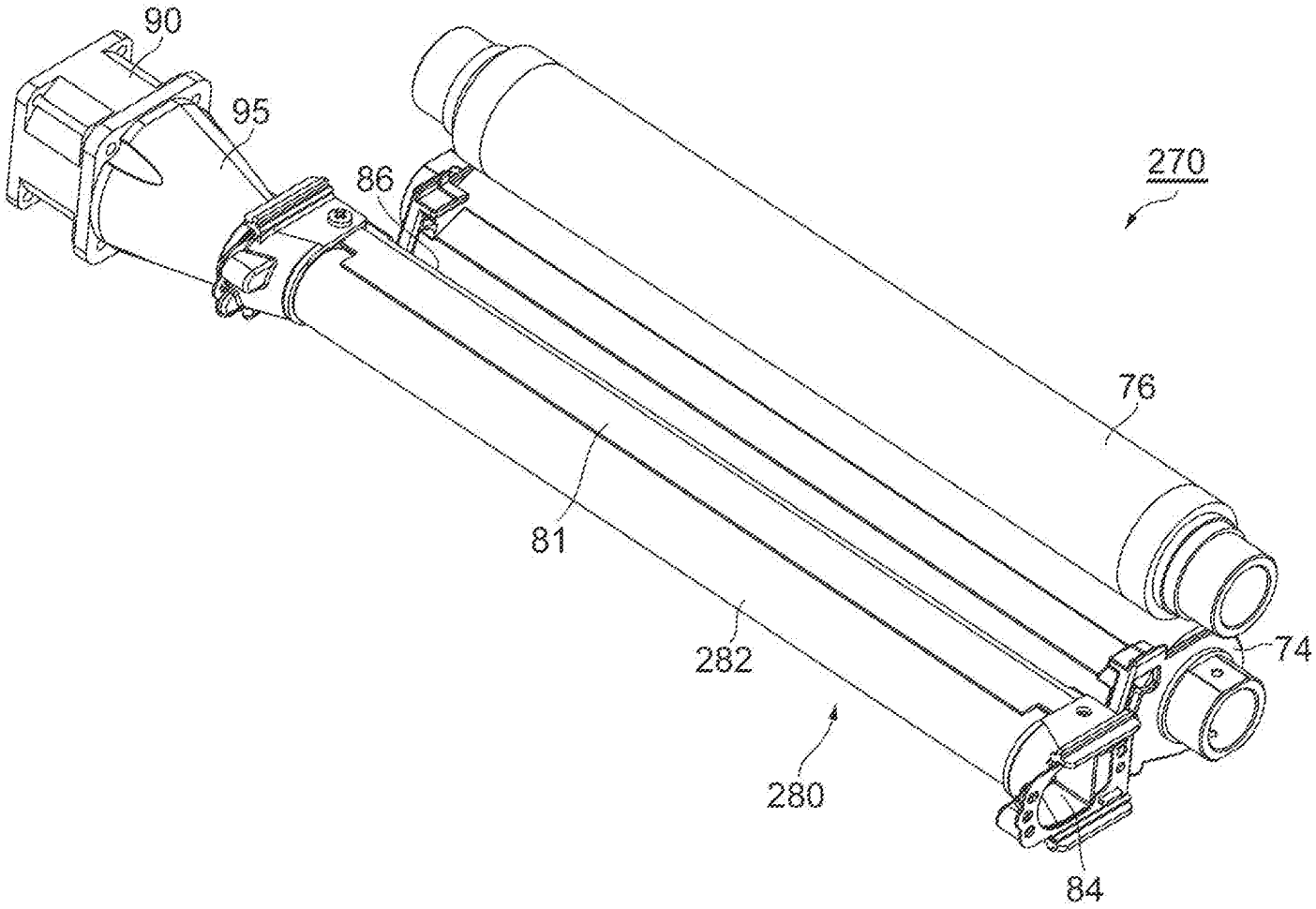
FIG. 8 is a perspective view of an example gloss processing device.

With reference to FIG. 8, an example gloss processing device 270 includes circulation controlling apparatus (or cooling apparatus or device) 280 having a slit 86 and a rotatable roller that extends along a substantial length of the circulation controlling apparatus 280, to form the curved portion 282, for example as a replacement of belt rollers 83 (cf. FIG. 6). The rotatable roller rotates along an axis parallel to the axis of the heating roller 74 or the like, to convey the conveyor belt 72 more smoothly and avoid tearing or damaging the conveyor belt 72. A flat portion 81 is disposed over the curved portion 282 having a roller function, such that the flat portion 81 partially overlaps the curved portion 282, to avoid leakage of the cooling air between the curved portion 282 and the flat portion 81.

The invention claimed is:

1. A system comprising:
an endless belt to convey a medium;
a heating member to heat the endless belt;
a pressure member to press the endless belt against the heating member; and
a cooling device in contact with the endless belt at a non-linear portion of the endless belt which at least partially wraps around the cooling device, wherein the cooling device comprises:
a ventilation interior portion that is an interior space inside the cooling device and that extends in a longitudinal direction of the cooling device, the ventilation interior portion to provide a cooling airflow along the longitudinal direction of the cooling device, and
a slit extending along the longitudinal direction of the cooling device and to discharge the cooling airflow from the ventilation interior portion through the slit to outside the cooling device and toward an inner circumferential surface of the endless belt.

2. The system of claim 1,
wherein the non-linear portion of the endless belt includes a separation point to separate the medium from the endless belt,
wherein the pressure member presses the endless belt against the heating member at a nip region, and
wherein a linear portion of the endless belt formed between the nip region and the separation point is connected to the non-linear portion of the endless belt at the cooling device.

3. The system of claim 2, wherein the cooling device includes a flat portion in contact with the linear portion of the endless belt.

4. The system of claim 1, wherein the cooling device includes a curved portion in contact with the non-linear portion of the endless belt.

5. The system of claim 1, comprising:
a ventilation system to generate the cooling airflow to pass through the ventilation interior portion of the cooling device,
wherein the longitudinal direction of the cooling device is perpendicular to a conveying direction of the endless belt.

6. The system of claim 1, wherein the cooling device includes a flat portion and a curved portion that extends from the flat portion, the curved portion contacting the non-linear portion of the endless belt, and the flat portion contacting a linear portion of the endless belt.

7. The system of claim 6, wherein the flat portion extends from the curved portion along a tangent line of the curved portion.

8. The system of claim 6, wherein the flat portion and the curved portion of the cooling device comprise a metal.

9. The system of claim 1, comprising a heat pipe in contact with an inner surface of the cooling device.

10. The system of claim 1, wherein the cooling device comprises a guide wall provided in the ventilation interior portion, to guide the cooling airflow along the longitudinal direction.

11. The system of claim 1, comprising:
a wind shield wall provided between the cooling device and the heating member, to inhibit the cooling airflow discharged from the slit from reaching the heating member.

12. The system of claim 11, wherein the wind shield wall is a plate-shaped member that extends in the longitudinal direction of the cooling device, and wherein the wind shield wall includes:
a first surface that faces the cooling device, and
a second surface, opposite to the first surface, that faces the heating member.

13. The system of claim 3, wherein the flat portion of the cooling device has a length in the longitudinal direction that is longer than a width of the endless belt in the longitudinal direction of the cooling device.

14. The system of claim 1, wherein the cooling device comprises a belt roller to rotate in accordance with a movement of the endless belt in a conveying direction of the endless belt.

15. The system of claim 10, wherein the guide wall extends along the longitudinal direction.

16. The system of claim 15, wherein the guide wall comprises a plate-shaped member extending along the longitudinal direction.

17. The system of claim 16, wherein the cooling airflow is along a space between the plate-shaped member and the slit.

18. A system comprising:
an endless belt to convey a medium in a conveying direction;
a heating member to heat the endless belt;
a pressure member to press the endless belt against the heating member; and
a cooling device in contact with the endless belt at a non-linear portion and at a linear portion of the endless belt, wherein the cooling device comprises:
a ventilation interior portion that is an interior space inside the cooling device and that extends in a longitudinal direction of the cooling device, the ventilation interior portion to provide a cooling airflow along the longitudinal direction of the cooling device, wherein the longitudinal direction intersects the conveying direction, and
a slit extending along the longitudinal direction of the cooling device and to discharge the cooling airflow from the ventilation interior portion through the slit to outside the cooling device and toward an inner circumferential surface of the endless belt.

19. The system of claim 18, wherein the cooling device includes a flat portion and a curved portion that extends from the flat portion, the curved portion contacting the non-linear portion of the endless belt, and the flat portion contacting the linear portion of the endless belt.

20. The system of claim 19, wherein the flat portion extends from the curved portion along a tangent line of the curved portion.

* * * * *